US008406710B1

(12) United States Patent
Soe

(10) Patent No.: US 8,406,710 B1
(45) Date of Patent: Mar. 26, 2013

(54) METHOD AND APPARATUS OF MINIMIZING EXTRINSIC PARASITIC RESISTANCE IN 60 GHZ POWER AMPLIFIER CIRCUITS

(75) Inventor: Zaw Soe, Encinitas, CA (US)

(73) Assignee: Tensorcom, Inc., Carlsbad, CA (US)

( * ) Notice: Subject to any disclaimer, the term of this patent is extended or adjusted under 35 U.S.C. 154(b) by 0 days.

(21) Appl. No.: 13/243,986

(22) Filed: Sep. 23, 2011

(51) Int. Cl.
*H01Q 11/12* (2006.01)
*H04K 3/00* (2006.01)

(52) U.S. Cl. ..... 455/120; 455/127.1; 330/154

(58) Field of Classification Search ..... 455/120, 455/127.1, 341; 330/154, 165, 276, 299
See application file for complete search history.

(56) References Cited

U.S. PATENT DOCUMENTS

| | | | | |
|---|---|---|---|---|
| 5,264,736 | A | 11/1993 | Jacobson | |
| 5,396,128 | A | 3/1995 | Dunning | |
| 5,396,195 | A | 3/1995 | Gabara | |
| 5,589,783 | A | 12/1996 | McClure | |
| 5,959,504 | A | 9/1999 | Wang | |
| 7,897,484 | B2 * | 3/2011 | Kar-Roy et al. | 438/459 |
| 8,004,361 | B2 | 8/2011 | Lin | |
| 2007/0090877 | A1 | 4/2007 | Bagheri | |
| 2007/0115086 | A1 | 5/2007 | Molins | |
| 2010/0039092 | A1 | 2/2010 | Cordier | |

OTHER PUBLICATIONS

U.S. Appl. No. 13/163,562, KhongMeng Tham.

Behzad Razavi, Ran-Hong Yan, and Kwing F. Lee, "Impact of Distributed Gate Resistance on the Performance of MOS Devices", IEEE Transactions on Circuits and Systems-I: Fundamental Theory and Applications, vol. 41, No. II, Nov. 1994, pp. 750-754.

Wei L. Chan, John R. Long, Marco Spirito, John J. Pekarik, "A 60GHz-Band 1V 11.5dBm Power Amplifier with 11% PAE in 65nm CMOS", Session 24.4, Feb. 11, 2009, IEEE International Solid-State Circuits Conference, San Francisco, CA.

47 CFR § 15.257 Operation within the band 57-64 GHz.

Chen, M; Wang, K H; Zhao, D; Dai, L; Soe, Z; Rogers, P. "A CMOS Bluetooth Radio Transceiver Using a Sliding-IF Architecture", IEEE 2003 Custom Integrated Circuits Conference.

* cited by examiner

*Primary Examiner* — Lee Nguyen
(74) *Attorney, Agent, or Firm* — Thaddeus Gabara; Tyrean Patent Prosecution Law Firm

(57) ABSTRACT

Very high frequency circuits suffer from parasitic resistances. At 60 GHz, conventional layout techniques can introduce loss into the circuit at critical locations. One critical interconnect between the output of a pre-driver and the gate of the final output stage causes 1 or 2 dB of loss due to the layout. By minimizing the number of via contacts, this conventional loss can be recovered using this new layout technique. In addition, a tap point of a via stack is used to modify the resonant characteristics of the interconnect. Finally, cross coupled devices in a resonant circuit are used to reduce the common mode noise at the expense of the common mode gain.

27 Claims, 6 Drawing Sheets

| | ρ (Ω/sq) | Resistance (Ω) | Stacked Contacts | Width (um) | Length (um) | Number | $R_{para}$ (Ω) |
|---|---|---|---|---|---|---|---|
| $R_{gate}$ | 13 | 13*(1/.04)/100/3 | ---- | 1 | 0.04 | 100 | 1.08 |
| $R_{gateext}$ | 13 | 13*(.08/.04)/100 | ---- | 0.08 | 0.04 | 100 | 0.26 |
| $R_{contact}$ | 60 | 12*60/100 | 12 | ---- | ---- | 100 | 7.2 |

FIG. 5a $$R_{StackPlugVia} = 1.08 + 0.26 + 7.2 = 8.54\ \Omega$$

| | ρ (Ω/sq) | Resistance (Ω) | Width (um) | Length (um) | Number | $R_{para}$ (Ω) |
|---|---|---|---|---|---|---|
| $R_{gate}$ | 13 | 13*(1/.04)/100/3 | 1 | 0.04 | 100 | 1.08 |
| $R_{gateext}$ | 13 | 13*(.08/.04)/100 | 0.08 | 0.04 | 100 | 0.26 |
| $R_{contact}$ | 60 | 60/100 | ---- | ---- | 100 | 0.6 |

FIG. 5b $$R_{MinRes} = 1.08 + 0.26 + 0.6 = 1.94\ \Omega$$

METHOD AND APPARATUS OF MINIMIZING EXTRINSIC PARASITIC RESISTANCE IN 60 GHZ POWER AMPLIFIER CIRCUITS

CROSS REFERENCE TO RELATED APPLICATIONS

The present application is related to the co-filed U.S. application Ser. No. 13/243,880 filed on the same day herewith entitled "A Differential Source Follower having 6 dB Gain with Applications to WiGig Baseband Filters", and the co-filed U.S. application Ser. No. 13/243,908 filed on the same day herewith entitled "A High Performance Divider Using Feed Forward, Clock Amplification and Series Peaking Inductors," both filed on Sep. 23, 2011, which are invented by the same inventor as the present application and incorporated herein by reference in their entireties.

BACKGROUND OF THE INVENTION

The Federal Communications Commission (FCC) has allotted a spectrum of bandwidth in the 60 GHz frequency range (57 to 64 GHz). The Wireless Gigabit Alliance (WiGig) is targeting the standardization of this frequency band that will support data transmission rates up to 7 Gbps. Integrated circuits, formed in semiconductor die, offer high frequency operation in this millimeter wavelength range of frequencies. Some of these integrated circuits utilize Complementary Metal Oxide Semiconductor (CMOS), Silicon-Germanium (SiGe) or GaAs (Gallium Arsenide) technology to form the dice in these designs. At 60 GHz, achieving the desired parameters of gain in a transmitter is significantly influenced by the layout.

Cost is a driving force in electronic products. Integration of circuit has allowed many more devices into the die. In addition, massive computation is typically requires when operating wireless systems. This has forced analog designers to introduce their circuit techniques into 8 layer metal CMOS processes more geared for digital logic manipulation rather than analog functions. The intersection of high speed analog circuits (60 GHz) with massive digital blocks has introduced resistive losses that influence the analog designs greatly.

Conventional physical layout techniques in high frequency circuit design introduce unnecessary loss. Any technology being pushed to the limit, as in the design of 60 GHz transmitters, makes these losses more pronounced. These losses influence target objectives and can cause the chip or die to fail meeting the specifications. New layout techniques are required to overcome these losses.

BRIEF SUMMARY OF THE INVENTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

One of the embodiments of the disclosure modifies the metal level being used to interconnect devices. Certain points within a high frequency circuit suffer more loss than other points within the circuit. One particular point is between the pre-driver and the final output stage of a transmitter. The pre-driver has an inductive load and the resistive path between the drain of the pre-driver and the inductor has always been minimized in lower frequency designs at the expense of all other coupling points. However, at 60 GHz, the interconnect between the junction of an inductively loaded transistor and the gate of the following stage becomes much more important.

An embodiment of the invention is the removal of a significant resistance in this coupling path. The contact resistance of via stacks can play a large role in reducing the gain or increasing the loss of the transmitter stage. The significant resistance that is reduced is caused by the removal of two via stacks between the pre-drive and the final output stage. Each via stack can introduce up to 8 series contact resistances, causing the contact resistance to multiple correspondingly. Removal of these contact resistances can increase the gain by 2 dB.

Another embodiment uses the cross coupled devices in the final stage of a power amplifier to reduce the common mode oscillations. The cross coupled devices behave as diode connected devices when a common input signal is applied to the power amplifier. The resistive loss of the diode connected devices removes energy from the resonant circuit reducing the common mode oscillations. For differential mode signals, however, the cross coupled devices provide a negative resistance to compensate for any resistive losses enhancing the oscillations.

BRIEF DESCRIPTION OF THE DRAWINGS

Please note that the drawings shown in this specification may not necessarily be drawn to scale and the relative dimensions of various elements in the diagrams are depicted schematically.

The inventions presented here may be embodied in many different forms and should not be construed as limited to the embodiments set forth herein. Rather, these embodiments are provided so that this disclosure will be through and complete, and will fully convey the scope of the invention to those skilled in the art. In other instances, well-known structures and functions have not been shown or described in detail to avoid unnecessarily obscuring the description of the embodiment of the invention. Like numbers refer to like elements in the diagrams.

FIG. 5*a* presents the tabular results of resistance in accordance with the present invention.

FIG. 5*b* illustrates the tabular results of resistance in accordance with the present invention.

DETAILED DESCRIPTION OF THE INVENTION

Figure 1A:
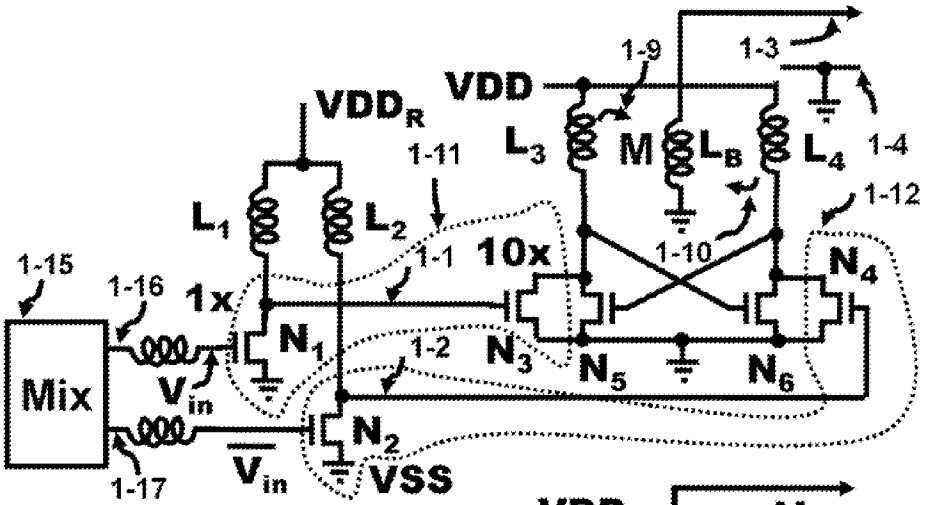
FIG. 1*a* depicts the transmitter circuit of a 60 GHz transceiver in accordance with the present invention.

The inventions presented in this specification can be used in any high frequency system design. One application of the invention can be applied to the transmitter end of a transceiver circuit which is illustrated in FIG. 1*a*. This particular transmitter has the outputs 1-16 and 1-17 of the Gilbert differential mixer 1-15 coupled to the gates of $N_1$ and $N_2$ by a metal interconnect. The metal interconnects are modeled as $L_{in}$ and $L'_{in}$ (see FIG. 1*c*) and are dependent on their length. If the routing is long, then the routing model becomes a low pass filter and attenuates the signal. If the routing is proper sized, the inductor is modeled as a series peaking inductor. The signal, in this case, has minimum attenuation and behaves as a bandpass filter due to the series peaking inductors in the series path of the interconnect that routes the outputs of the mixer to the gates of $N_1$ and $N_2$. The series peaking inductor resonates with the corresponding gate capacitance of $N_1$ or $N_2$ and capacitive output of the mixer to form a bandpass filter that manipulates the RF mixer output signal.

The mixer, the interconnect, a pre-drive stage, and a final drive stage generate a balanced signal while a balun transforms the magnetically coupled signal into a single ended signal so that the output can drive an antenna. The pre-drive stage, final driver stage and balun comprises the power amplifier. The pre-drive for has two N channel devices, $N_1$ and $N_2$, coupled to ground and driven by a differential signal $V_{in}$ and $\overline{V_{in}}$ provided by the mixer, respectively. The load for the two N channel devices, $N_1$ and $N_2$, in the pre-drive consists of an inductor, $L_1$ and $L_2$, respectively. These inductors are formed in metal 7 of the die. The numeric after the word metal indicates the level that the inductor has been formed. In total, this die is assumed to have 8 layers of metal. Each metal layer is about 0.5 μm thick except for the top layer metal 8 which can be 1 μm thick or more. The far end of the inductors $L_1$ and $L_2$ are coupled together and coupled to a regulated power supply, $VDD_R$. Each output signal (1-1 and 1-2) is provided between the drain of the device and the inductor load and taken together forms a differential signal that is coupled to the next stage.

A resonant circuit comprises at least one inductor and at least one capacitor. The inductors can have a parasitic capacitance, and possibly an intended capacitance (controlled electrically) and together with said inductors form a resonant circuit. The resonant circuit illustrated in FIG. 1*a* has an oscillation period of about 15 to 20 ps and is driven by the two devices $N_1$ and $N_2$.

The next stage is the final driver stage which also has a balanced or differential structure and uses cross coupling within an LC tank circuit (the capacitance is not shown). The inputs to the stage are the nodes 1-1 and 1-2. The nodes are coupled to the gates of devices (transistors) $N_3$ and $N_4$. The gates of these devices present a capacitive load to the previous stage. The outputs of the final driver stage are the mutual magnetic coupling M 1-9 and 1-10 between $L_3$ and $L_4$ to inductor $L_B$, respectively. The cross coupled devices are $N_5$ and $N_6$ where the drain of $N_5$ couples to the gate of $N_6$, and the drain of $N_6$ couples to the gate of $N_5$ while their sources are coupled to ground. $N_5$ is coupled in parallel to the device $N_3$ while $N_4$ is coupled in parallel to the device $N_6$. The width of the devices $N_5$ and $N_6$ are scaled by 1/a from that of $N_3$ and $N_4$, in this case, $\alpha$=20. FIG. 1*a* also shows the first set of parallel devices, $N_3$ and $N_5$, are coupled to an inductor $L_3$ that couples to the power supply. The second set of parallel devices, $N_4$ and $N_6$, are coupled to an inductor $L_4$ which also couples to the power supply. These inductors are formed in metal 7 and interact magnetically with the inductor $L_B$ overlaying these two inductors in metal 8. Together these inductances with any parasitic capacitance, and possibly another intended capacitance (controlled electrically) form a second resonant circuit that oscillates when driven by the associated devices. The frequency of oscillation can be controlled by adjusting the electrical capacitance or by judicially transferring inductance between two branches as will be shortly described.

The scale factor $\alpha$ is selected to maximize the gain of the power amplifier with a minimum impact of non-linearity. The factor $\alpha$ a is the ratio of the width of $N_3$ to the width of $N_5$ which is also equal to the ratio of the width of $N_4$ to the width of $N_6$. The devices or components in each leg of the balanced circuit described in this specification have like sizes. Assume that devices $N_5$ and $N_6$ are removed, then $1/\alpha=0$. In this situation, the power amplifier has less gain since there is no positive feedback ($N_5$ and $N_6$ are removed). Therefore, the widths of the remaining devices in the pre-drive and final drive need to be increased in width to compensate for this loss of gain. Increasing the width of these devices has adverse effects, such as, larger area usage, more power dissipation due to larger currents flowing, and more susceptibility to common mode oscillations.

When the devices $N_5$ and $N_6$ are replaced, these devices introduce positive feedback in the final driver stage and increase the gain of the final driver stage due to the positive feedback of the cross coupled devices. Although these devices introduce more non-linearity into the circuit, these cross coupled devices also reduce the common mode oscillation of the power amplifier (described shortly). The reduction of the common mode oscillation is traded for an increase in non-linearity that is acceptable in the design of the power amplifier. This occurs when $\alpha$ is set to about 20 or $1/\alpha=0.05$. Thus, an acceptable width of $N_5$ is about 5% that of the width of $N_3$.

The common mode and differential mode signal behavior of the final driver stage is analyzed next to specifically show the benefit of the cross coupled devices $N_5$ and $N_6$ with regards to the suppression of common mode signal oscillation. For the common mode behavior, see FIG. 1*c* (equivalent components are identified in FIG. 1*a*), $N_1$ and $N_2$ become equivalent to each other such that the drains can be coupled together. Similarly, in the common mode behavior, devices $N_3$ and $N_4$ become equivalent to each other such that their gate and drain can be coupled together. The remaining devices, $N_5$ and $N_6$, now become diode connected, lose their regenerative capability and introduce loss into the stage such that any common mode oscillations are decreased. The inductors $L_3$ and $L_4$ always introduce a resistive loss. In this common mode case, the devices $N_5$ and $N_6$ present a common positive resistance of $1/(g_{m5}+g_{m6})$ to diminish the common mode oscillation signal where $g_m$ is the transconductance.

The differential mode analysis is now provided. The differential signal applied to the gates of devices $N_1$ and $N_2$ generates two separate differential signals at their drains which are applied to the gates of $N_3$ and $N_a$, respectively. The devices, $N_3$ and $N_4$, in turn, drive a resonant circuit formed by inductors $L_3$ and $L_4$ and the parasitic capacitances into oscillation, but the resistive loss of the inductors $L_3$ and $L_4$ decreases the energy of the oscillations. However, the cross coupled devices, $N_5$ and $N_6$, introduce a negative resistance of $-1/(g_{m5}+g_{m6})$. This negative resistance compensates for the resistive loss of energy in the inductors $L_3$ and $L_4$ and sustains the oscillation of the differential signal.

Note that the inductor $L_B$ is coupled to ground (VSS, GRD) at one end 1-4. The output 1-3 is extracted from the other end of the inductor $L_B$ and is provided with respect to GRD. This structure is known as a balun and transfers the balanced or differential signal generated across the inductors $L_3$ and $L_4$ and couples the energy to the inductor $L_u$ located directly above the inductors $L_3$ and $L_4$. The energy in inductor $L_B$ is now with respect to ground and this energy propagates to the load through the bond pad and solder bump to the outputs of the die 1-3 and 1-4. The load in this case is an antenna which typically has a low impedance ranging around 50 to 100 ohms. In order to drive this low impedance, the transistors in the driver stage must be large to carry the large currents required to drive the low impedance antenna.

The pre-driver stage must amplify the signal to drive the final driver stage. The driving device $N_1$ is 10 times smaller in width than the driven device $N_3$. In the dotted enclosure 1-11, the device $N_1$ is coupled to the gate of device $N_3$ and in the dotted enclosure 1-12, the device $N_2$ is coupled to the gate of device $N_4$. These large devices ($N_3$ and $N_4$) also have a large parasitic gate capacitance. In FIG. 1*a*, the drains of the pre-driver outputs are coupled directly to the gate of the transistors in the final driver stage (see 1-1 and 1-2).

Figure 1B:
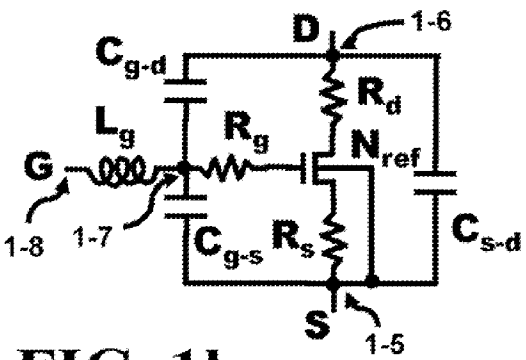
FIG. 1*b* shows a high frequency model of the MOS device in accordance with the present invention.

At this point, it is helpful to review the high frequency model for transistors which is illustrated in FIG. 1*b*. The ideal transistor being modeled is shown in the middle of the box. To make the model more useful, parasitic elements are introduced into the model. These parasitic elements mimic reality. The ideal transistor is coupled to these parasitic elements. Resistors $R_s$, $R_g$ and $R_d$ introduce source, gate and drain resistances respectively. The substrate of the transistor $N_{ref}$ is coupled to the external source 1-5. A capacitor $C_{s-d}$ is placed between the source 1-5 and drain 1-6 leads. A gate to source capacitance, $C_{g-s}$, is placed between the source and the node 1-7 while a second capacitor $C_{g-d}$ is placed between the drain 1-6 and in front of the gate resistance $R_g$. Finally, a gate inductance, $L_g$, couples the node 1-7 to the external gate 1-8.

Figure 1C:
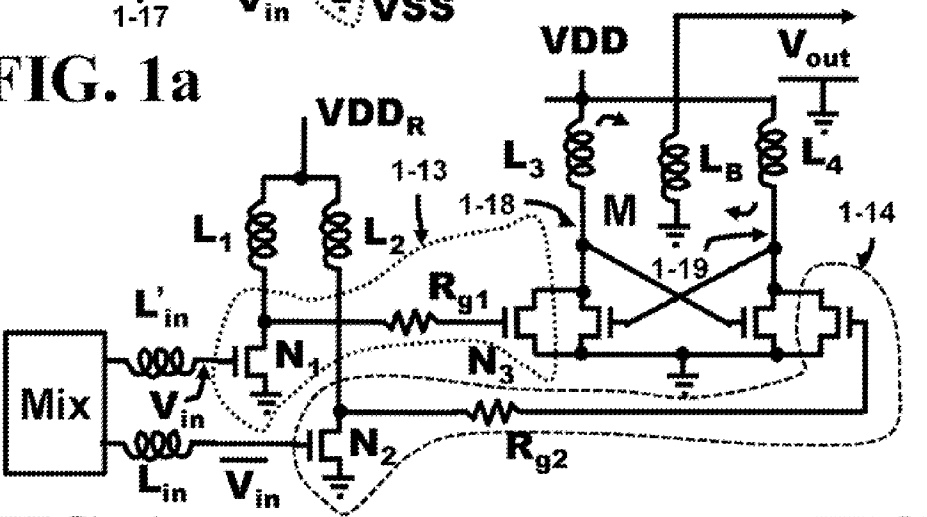
FIG. 1*c* illustrates the transmitter circuit of a 60 GHz transceiver with gate resistance in accordance with the present invention.

FIG. 1*c* duplicates FIG. 1*a* with the exception that the connections 1-1 and 1-2 are broken and a gate resistor, $R_{g1}$ and $R_{g2}$, is added in each path. In the dotted enclosure 1-13, the device $N_1$ is coupled to the gate of device $N_3$ and in the dotted enclosure 1-14, the device $N_2$ is coupled to the gate of device $N_4$. This resistance is comprised of the gate resistance used to form the self aligned channel, any poly over field ox, and contact resistance between the polysilicon (poly) and metal 1. Included in each dotted enclosure, but not shown, is the inductor $L_g$, as illustrated in the model of FIG. 1*b*, has also been added in series with gate resistor. There are additional resistances that will not be addressed here; these include the sheet resistance of metal 1 between the pre-drive stage and the final driver stage. Also, the contact resistance of the pre-drive stage drain connecting to metal 1 has not been presented to simplify the diagram.

Figure 1D:
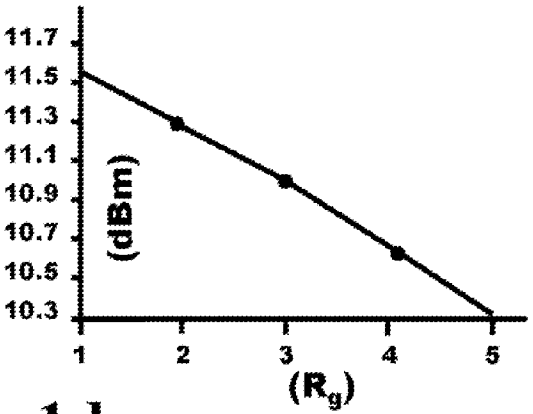
FIG. 1*d* graphs the effect of the series gate resistance against the gain of the circuit in accordance with the present invention.

Referring to FIG. 1*d*, a graph of the dBm gain versus gate resistance is provided. Note that as the gate resistance decreases, the gain of the transmitter increases. For example, decreasing the resistance from 5Ω down to 2Ω improves the gain by one dB. The values of $R_{g1}$ and $R_{g2}$ can be determined from visual inspection of the layout or XY mask. Once the gate resistance has been estimated, the value can be applied to the graph and compared against an estimation of the gate resistance of the previous layout.

Figure 2:
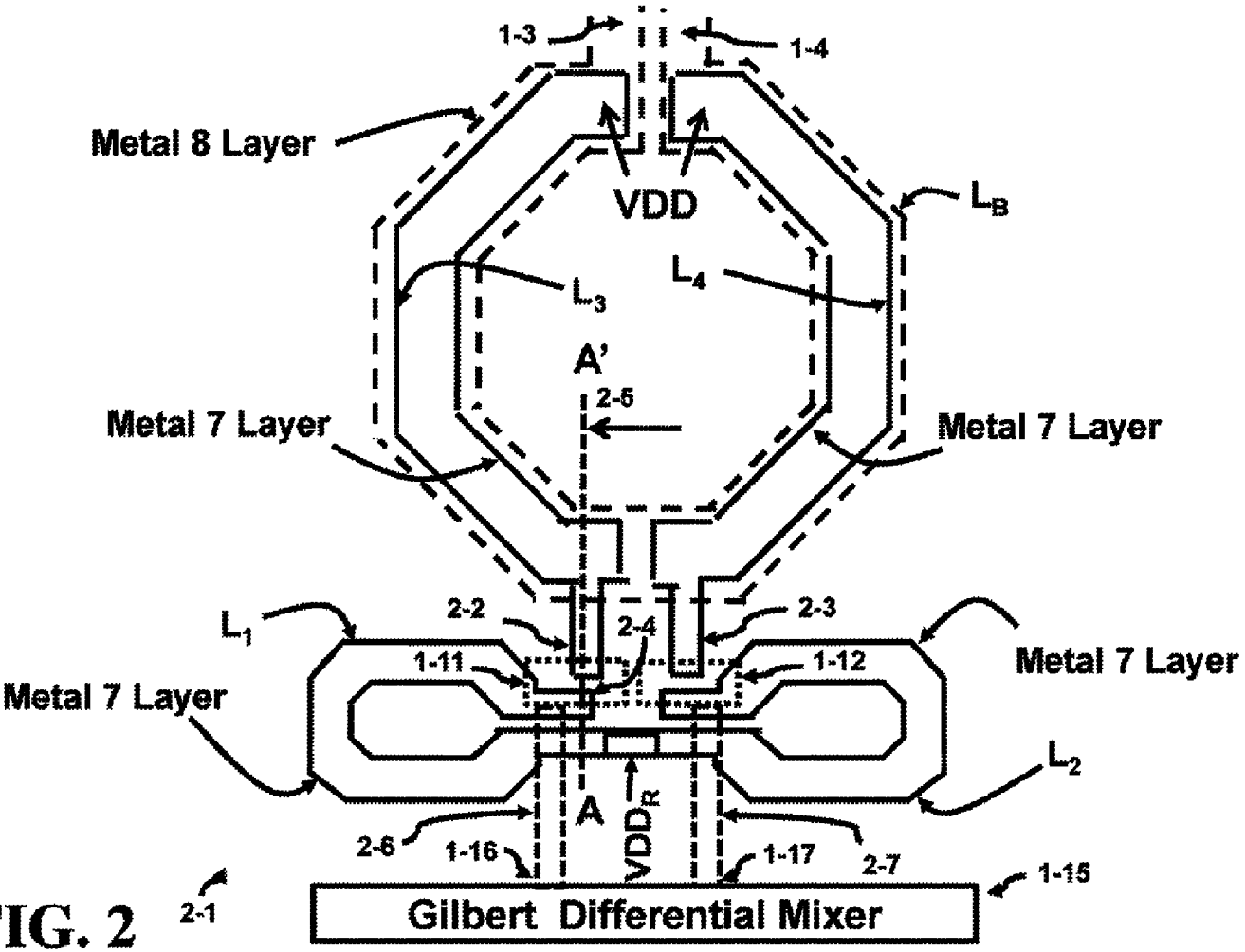
FIG. 2 presents the top view of the XY mask layout for the transmitter circuit in FIG. 1*a* or FIG. 1*c* in accordance with the present invention.

FIG. 2 illustrates a top view of the layout 2-1 of the transmitter. The inductors $L_1$ and $L_2$ are shown in the lower portion of the diagram and are fabricated in the metal 7 layer (these inductors are shown with a solid line). One end of inductors $L_1$ and $L_2$ share a common node and are coupled to $VDD_R$ which is a regulated VDD power supply. The other end of the inductor $L_1$ is coupled to the $N_1$ device in the dotted enclosure 1-11 while the other end of the inductor $L_2$ is coupled to the $N_2$ device in the dotted enclosure 1-12. These two enclosures were identified in FIG. 1*a*. In addition, the gate of the devices $N_1$ and $N_2$ in the enclosures are coupled by the two wide metal traces 2-6 and 2-7 to the outputs 1-16 and 1-17 of the Gilbert differential mixer 1-15. The two wide metal traces are modeled as the two series peaking inductors $L_{in}$ and $L'_{in}$ presented in FIG. 1*c*. Also coupled to the dotted enclosure 1-11, is the first end 2-2 of the inductors $L_3$. The first end 2-3 of $L_4$ is coupled to the dotted enclosure 1-12, and both of these inductors, $L_3$ and $L_4$, are fabricated in the metal 7 layer. The other end of these inductors $L_3$ and $L_4$ are coupled to VDD.

The dotted enclosures 1-11 and 1-12 correspond to the dotted enclosures given in FIG. 1*a* which in this case assumes that the gate resistance is zero. On the other hand, these dotted enclosures can be replaced by the dotted enclosures corresponding to 1-13 and 1-14 given in FIG. 1*c* which in this case provides gate resistance and introduces loss.

Finally, an inductor $L_B$ is fabricated in the metal 8 layer (these inductors are shown with a dashed line) and overlays the $L_3$ and $L_4$ inductors providing a good magnetic coupling factor. As these two inductors, $L_3$ and $L_4$, are driven by a signal, the balun formed by $L_B$, $L_3$ and $L_4$ transforms the differential signal into a single ended one at node 1-3 while node 14 is grounded (VSS). The left dotted enclosure marked 1-11 contains the transistors $N_1$ and $N_3$, while the right dotted enclosure marked 1-12 contains the transistors $N_2$ and $N_4$. Now referring to FIG. 1*a* and FIG. 2, the drain of $N_1$ is coupled to a via stack (not shown) and couples to one end 2-2 of $L_1$. The common node between $L_1$ and $N_1$ couples to the gate of $N_3$. The drain of device $N_3$ is coupled to a via stack (not shown) and couples to one end 2-2 of $L_3$. Similarly, the common node between $L_2$ and $N_2$ couples to the gate of $N_4$. The drain of device $N_4$ is coupled to a via stack (not shown) and couples to one end 2-3 of $L_4$. The cross-sectional view (direction of arrow 2-5) provided in the next figure is along the dotted line A-A'.

Figures 3A, 3B, 3C:
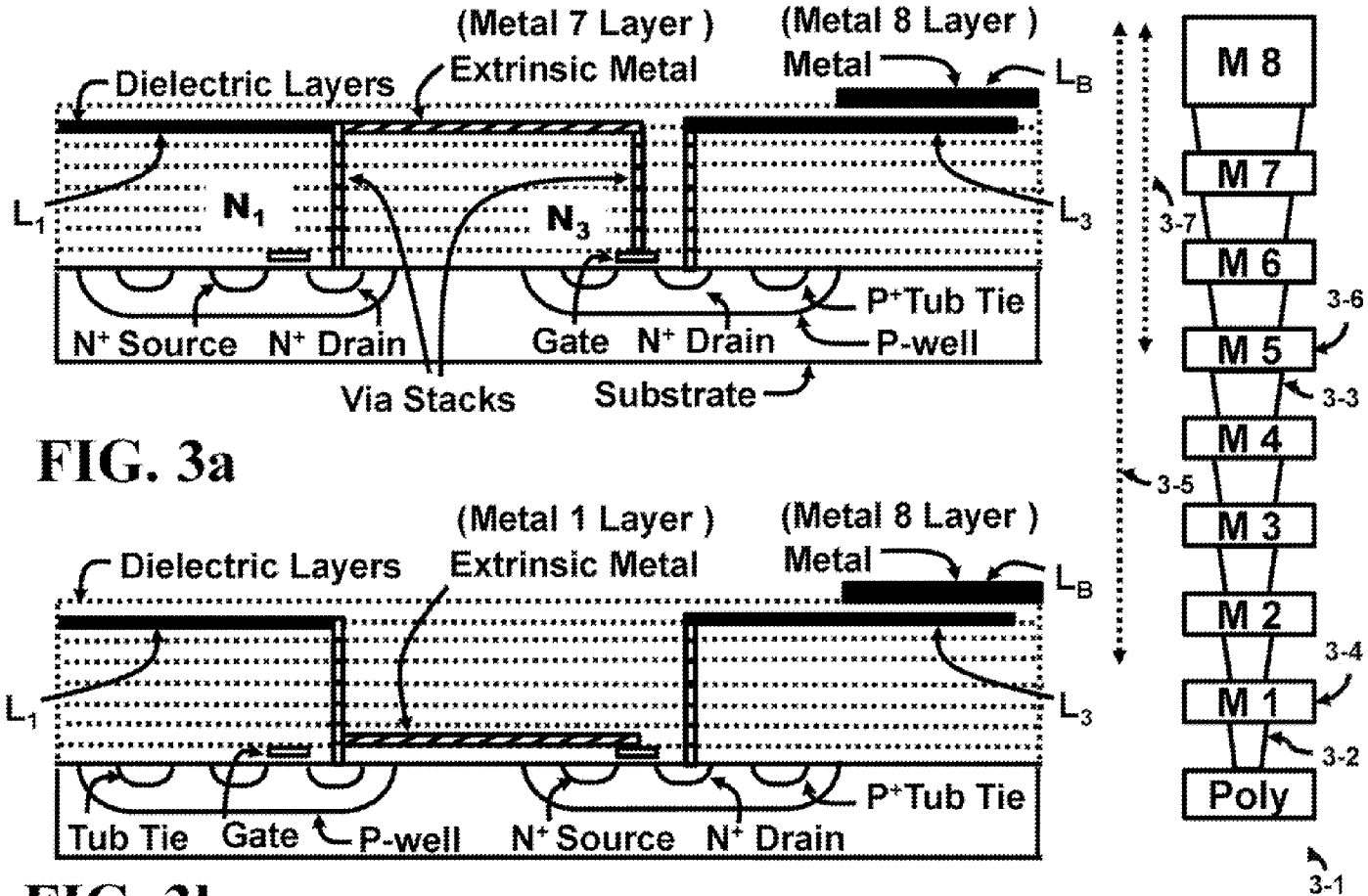
FIG. 3*a* shows a cross-sectional view of the die along A-A'.
FIG. 3*b* presents a cross-sectional view of the die along A-A' in accordance with the present invention.
FIG. 3*c* depicts a via stack in accordance with the present invention.

FIG. 3*a* illustrates a cross-sectional view of a transmitter within a die with eight metal layers. The transistors of interest are $N_1$ and $N_3$ and these devices are illustrated in this cross-sectional view corresponding to the cut A-A'. The direction of view is presented as 2-5. This diagram shows the substrate and within the lower portion of the substrate their P wells and $N^+$ source drain regions defining transistors or devices as well as the $P^+$ tub tie contacts to tie the tub to a voltage potential. The location of transistor $N_1$ is on the left while the location of the transistor $N_3$ is on the right with the gate in this particular case being identified. From the previous diagram given in FIG. 1*e*, $N_1$ is coupled to the inductor $L_1$ (which is formed in the solid metal 7) by the left via stack. The upper layer metals for an 8 layer metal die are metal 5 through metal 8, while the lower layer metals are metal 1 through metal 4. An extrinsic metal connection (hatched line) is made in the metal 7 layer till the connection is over the gate of $N_3$ then the connection follows the middle via stack down to the gate of $N_3$. The solid and hatched metal 7 layers are identical except that inductors are formed in the solid layers while the extrinsic parasitic resistive connection is formed in the hatched layers. The drain of $N_3$ is coupled to the right via stack and couples up to $L_3$ formed on metal 7. $L_3$ is further mutually coupled to inductor $L_B$ which is formed again in metal but this time in the metal 8 layer. Typically, the top metals in a technology are significantly thicker than any of the lower layer metals. The dielectric layers are illustrated in this figure by the horizontal dotted lines and each one of these layers is approximately 0.5 μm thick. The metal 1 through metal 7 layers are also about 0.5 μm thick while the metal 8 layer can be over 1 μm thick. The height of these via stacks are about 3 to 4 μm.

In earlier high frequency designs of 2.4 to 5 GHz, high frequency designers were much more concerned of the driver coupling to the inductor while the connection to the gate played less of a role of importance. This mentality remained with the circuit designer for historical reasons and through the progression of faster designs, CMOS circuits are now approaching frequencies of 60 GHz. Any loss in the circuit needs to be identified and corrected otherwise the performance suffers. The issue of placement of metallic interconnects requires reevaluation as demonstrated by the previous dBm curve given in FIG. 1*d*.

FIG. 3*b* illustrates the cross-sectional view of a transmitter within the die reducing the gate resistance and increasing the inductance of $L_1$. The cross-section in FIG. 3*b* resembles the cross-section given in FIG. 3*a* except that the extrinsic metal which was formed in the metal 7 layer for the previous case now is formed in the metal 1 layer. A visual comparison between these two cross-sectional views reveals immediately the removal of two via stacks in the gate resistance path between the drain of $N_1$ and the gate of $N_3$. in FIG. 3*b*. This is over 12 series via contact resistances as well as unnecessary parasitic inductance. The via stack introduces at least two parasitic components: resistance and inductance. This resistance and inductance can be used to adjust the gain, power delivery or resonant tuning of the transmitter.

To better understand the impact of placing the extrinsic metal on metal 1 layer, the illustration 3-1 in FIG. 3*e* is a very useful aid. A via stack also known as a stacked via, stacked plug, or stacked contact is illustrated in FIG. 3*c*. The via between different metal layers are placed over the via of the lower layers to save on area. However, as one progresses from poly to metal 1 to metal 2 and up to metal 7, the vias, for example 3-2 and 3-3, increase in diameter. Each via, for instance, the via 3-2 and the metal 1 layer introduce contact resistance and inductance. The via 3-3 and metal 5 also introduce contact resistance and resistance into the path. The via stack can be tapped to introduce/extract a signal into/out of the stack or alter the parasitics in a circuit. The tapping occurs when a metal layer is extended from the stack and this location is called a tap point. For example, the gate load of $N_3$ is coupled to the drain of $N_1$ using a trace formed in metal 1, as illustrated in FIG. 3*b*. This trace couples to the tap point 3-4. The inductance of the inductor is coupled to metal 8, for example, and is enhanced with the inductance associated with the portion of the stack 3-5 and tunes the resonant circuit formed by the inductor. However, if the stack is tapped at tap point 3-6, then the inductor coupled to metal 8 is only enhanced with the inductance associated with the portion of the stack 3-7.

There are six vias progressing from metal 1 up to metal 7. Then there are six vias progressing from metal 7 back down to metal 1. Each one of these minimum size via plugs can introduce up to 60 ohms (so for any given metal layer there needs to be multiple via plugs to decrease the resistance). In addition, the inductance of the via stacks can be used to tune an existing resonant circuit. The introduction of the gate resistance is now easy to see in FIG. 3*a* because of the left and middle via stacks introducing a total of 12 series via contact resistances while the cross-sectional view in FIG. 3*b* eliminates most of those two via stacks reducing the gate resistance of the case illustrated in FIG. 3*b* significantly and enhancing the inductance of $L_1$.

Figures 4A, 4B:
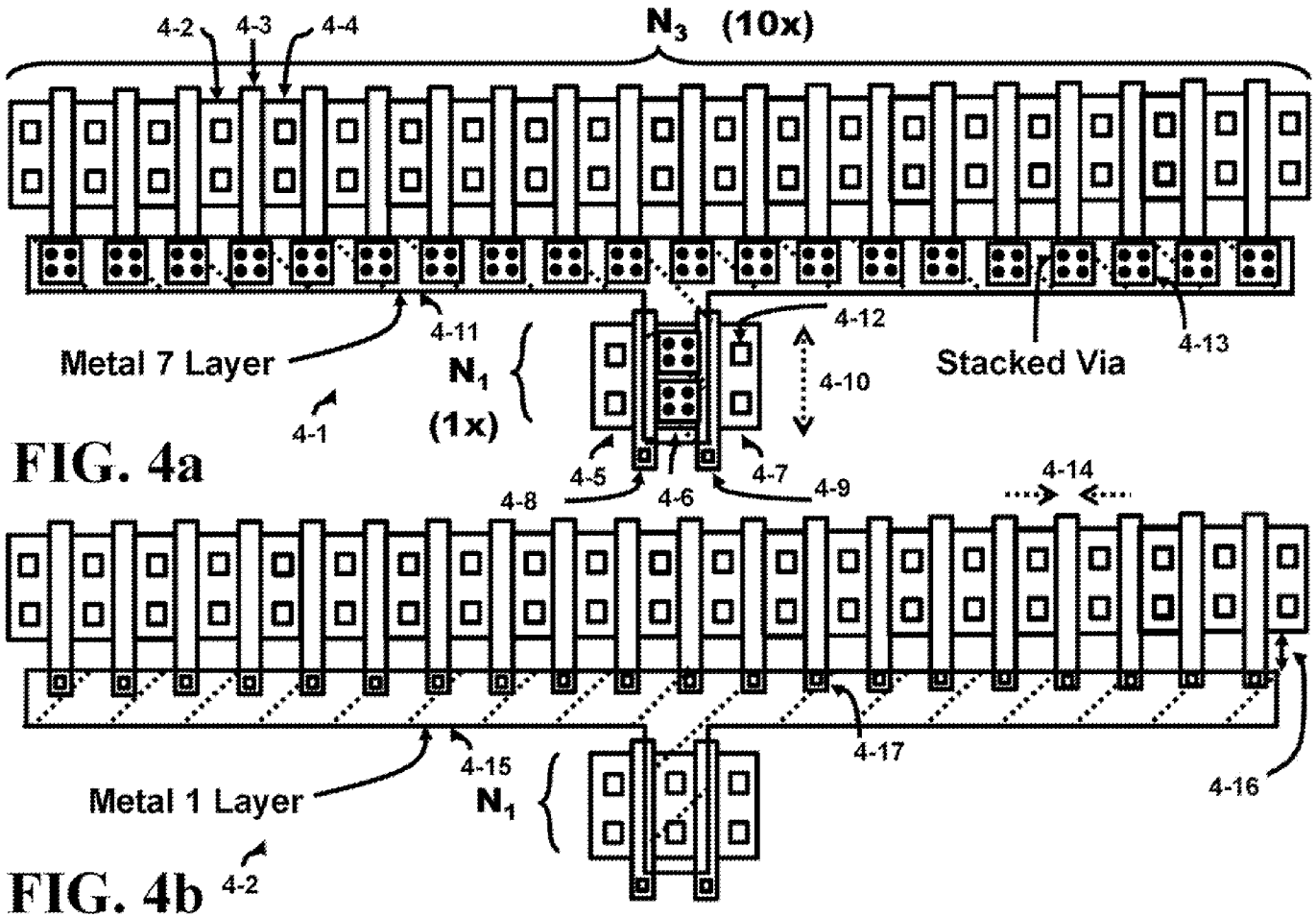
FIG. 4*a* illustrates via stacks coupling $N_1$ to $N_3$.
FIG. 4*b* shows $N_1$ coupling to $N_3$ using only metal 1 in accordance with the present invention.

A top view 4-1 of the layout provided in FIG. 3*a* is illustrated in FIG. 4*a*. The scale ratio of for $N_1$ and $N_3$ is depicted as 1 and 10, respectively, where the transistor $N_1$ has a width (2 times of the width 4-10) adding up to a total width of 1 μm while the transistor $N_3$ has a width that is 10 times greater. The lower transistor $N_1$ has the source regions 4-5 and 4-7 and the two parallel transistors share a common drain. The two source regions define the bounds of a rectangle which is known as thin-ox boundary. Poly gates 4-8 and 4-9 are deposited on the thin-ox defining the source/drain regions. The thin-ox is implanted with an $N^+$ dopant. Contacts 4-12 are opened in the source/drain regions and metal is deposited. The output of transistor $N_1$ goes up a stacked via 4-6 all the way up to metal 7. The reason for doing this in the past was to quickly get to the inductance since that was the critical aspect in earlier designs. However, at 60 GHz, this layout style has consequences.

Once the via stacks make contact to the metal 7 layer, the designer then runs the metal 7 layer to 4-11 which contacts the gates of device $N_3$ through the via stacks 4-13. From the metal 7 layer, the connection is made through the vias 4-13 all the way down to the gates of the $N_3$ devices. The source 4-4, gate 4-3 and drain 4-2 regions for the upper transistor $N_3$ are illustrated and the remaining source/drain regions occur every alternative position. The ground is connected to 4-4 and every other source. Thus, for this design or layout, the gate resistance includes two via stacks which increases the resistance quite dramatically as will be shown shortly.

The innovative way is illustrated in FIG. 4*b*. The via stacks have been eliminated. The drain of $N_1$ is coupled to the metal 1 layer using only drain to metal 1 contacts. Metal 1 makes contact 4-17 with the gates of $N_3$. The connection between the output device driver $N_1$ to the gates of all of the transistors in $N_3$ occurs on the metal 1 layer 4-15. This connection does not use via stacks. The gate length for the transistors is illustrated as 4-14. The last feature to describe here is the gate extension of output driver $N_3$. Surrounding any thin-ox rectangles is field-ox, a thicker dielectric. When poly is deposited, the gates are deposited over the field-ox to insure the integrity of the transistor. The gate is extension is indicated by 4-16.

The gate resistance for the eases of FIG. 4*a* and FIG. 4*b* are provided in the tables of FIG. 5*a* and FIG. 5*b*, respectively. In FIG. 5*a*, the vertical columns are p given in ohms per square, resistance given in ohms, the number of stacked contacts within the stacked vias, the transistor width, the gate length, the number of parallel gates and the final resistance for that row. The rows from top to bottom include the equivalent gate resistance, the resistance of the gate extension and the resistance of the contact to metal 1.

The sheet resistance of the poly gate is 13 ohms per square, the number of squares is one divided by 0.04, the number of poly gates is 100 and a division factor by three has been introduced from some previous published work published in IEEE Trans. Cir. and Sys.-I: Fundamental theory and applications, Vol. 41, No. 11, November 1994, *Impact of Distributed Gate Resistance on the Performance of MOS Devices*, by Razavi, Ran and Lee. The gate resistance is determined to be 1.08 ohms. The next portion of the gate resistance is the gate extension resistance. The resistance is calculated as 13 ohms per square times the number of squares which is 0.08 divided by 0.04 time divided by the number of those pieces which is 100. This component of the gate extension resistance is 0.26 ohms. The last row is the contact resistance. For each minimum size contact, assume the contact resistance is 60 ohms, since the number of stacked contacts is 12, the total resistance is 12×60 divided by 100 since there are 100 minimum size contacts. This portion of the gate resistance is 7.2 ohms. Thus, the overall resistance of the two stacked vias introduced into the gate resistance is 8.54 ohms.

A similar analysis was performed for the inventive embodiment given in FIG. 4*b* and the table presents the results as given in FIG. 5*b*. Everything along the top is the same as before except the column stacked contacts is missing since only the contact to the metal 1 layer is used. The two via stacks are eliminated. The gate resistance is 1.08 ohms while the gate extension resistance is 0.26 ohms which is the same as before. However, the big difference now is the contact resistance. Each contact or minimum size contact introduces a resistance of 60 ohms. A 100 parallel contacts of minimum size contacts reduces the resistance by 100 and is now only 0.6 ohms. This last result is less than 10% of the previous case. When all three components are added together, the minimum resistance for this innovative layout is now 1.94 ohms.

Not all resistors have been accounted. For example, the sheet resistance of the metal layer interconnecting the drain of $N_1$ to the gate of $N_3$ has not been addressed. In addition, the contact resistance between the drain of $N_1$ and the metal 1 layer has not been addressed. Both of these values would shift the resistors values up and move to a different part of the curve. The importance aspect is the percent of improvement between the two end points.

Figure 6:
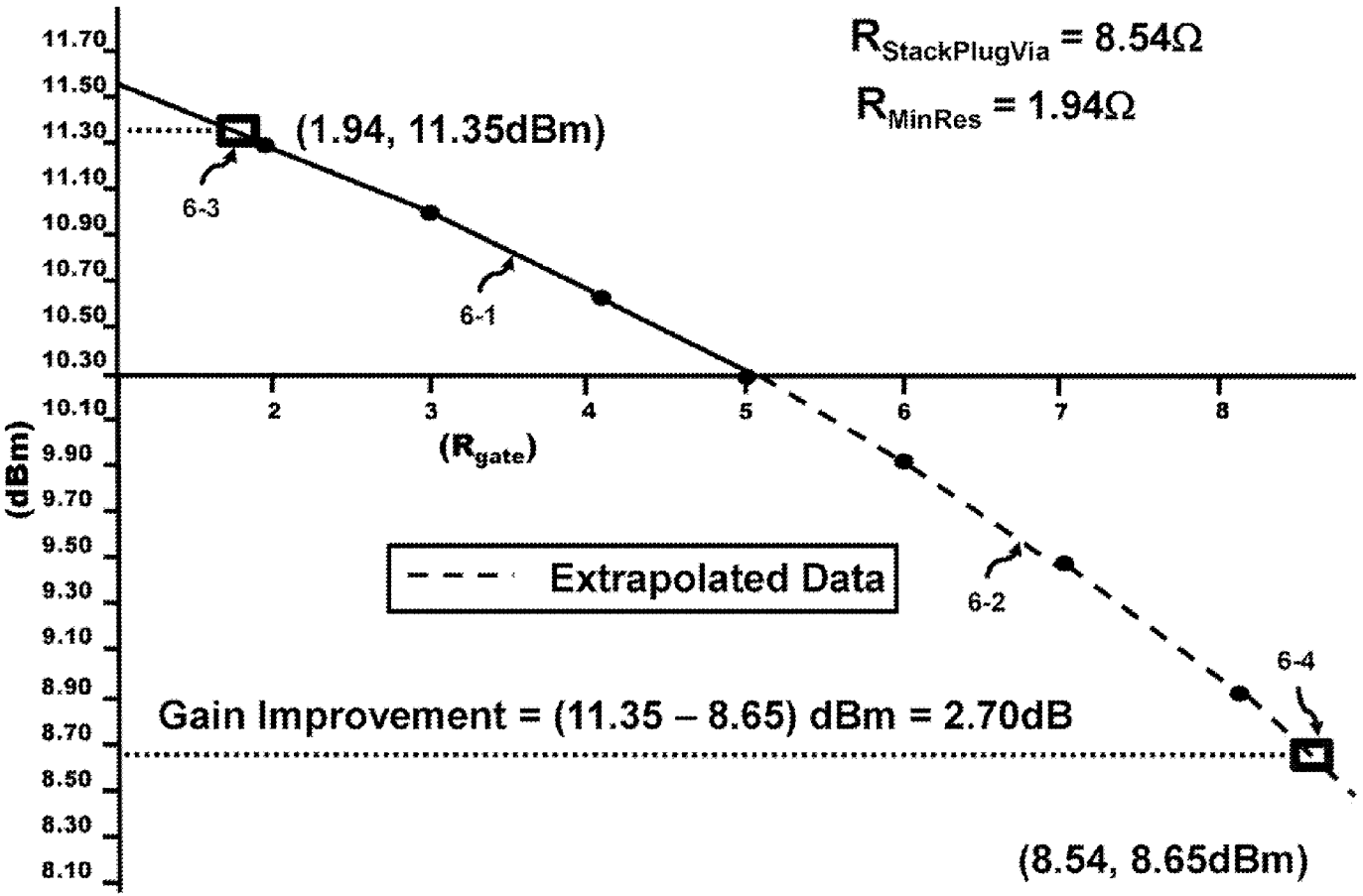
FIG. 6 shows the dBm loss curve as a function of $R_g$ in accordance with the present invention.

The graph of gate resistance versus dB end gain has been reproduced in FIG. 6 and the curve has been extrapolated to try to provide the significance of this new innovative layout technique. The original data is given as the line 6-1 and the extrapolated data is the dotted line or dashed line 6-2. The extrapolated data was made to try to capture for the gate value of 8.54 ohms. The resistance corresponding to FIG. 5*a* is illustrated in the box 6-4. At 6-4, the dBm is 8.65. The new resistance value of 1.94 is encompassed within the box 6-3 and in this case we see a dBm of 11.35. The overall gain improvement by reducing the two stacked vias is 11.35-8.65 dBm which is a 2.7 dB gain improvement.

Finally, it is understood that the above description are only illustrative of the principle of the current invention. Various alterations, improvements, and modifications will occur and are intended to be suggested hereby, and are within the sprit and scope of the invention. This invention may, however, be embodied in many different forms and should not be construed as limited to the embodiments set forth herein. Rather, these embodiments are provided so that the disclosure will be thorough and complete, and will fully convey the scope of the invention to those skilled in the arts. It is understood that the various embodiments of the invention, although different, are not mutually exclusive. In accordance with these principles, those skilled in the art may devise numerous modifications without departing from the spirit and scope of the invention. Although the circuits were described using CMOS, the same circuit techniques can be applied to depletion mode devices and BJT or biploar circuits, since this technology allows the formation of current sources and source followers. When a device is specified; the device can be a transistor such as an N-MOS or P-MOS. The CMOS or SOI (Silicon on insulator) technology provides two enhancement mode channel types: N-MOS (n-channel) and P-MOS (p-channel) devices or transistors. The via stacks can be fabricated using tungsten or copper. In addition, a network and a portable system can exchange information wirelessly by using communication techniques such as TDMA (Time Division Multiple Access), FDMA (Frequency Division Multiple Access), CDMA (Code Division Multiple Access), OFDM (Orthogonal Frequency Division Multiplexing), UWB (Ultra Wide Band), WiFi, WiGig, Bluetooth, etc. The network can comprise the phone network, IP (Internet protocol) network, LAN (Local Area Network), ad hoc networks, local routers and even other portable systems.

What is claimed is:

1. A transmitter comprising:

a first inductor formed in an upper metal layer of a die;

a drain of a first device coupled to said first inductor using a via stack, a tap point of said via stack selected to maximize inductance placed in series with said first inductor and minimize resistance placed in series between a load and said drain;

said tap point tapped to a different metal layer; and said different metal layer coupled to said load; whereby said transmitter is improved in performance.

2. The transmitter of claim 1, whereby said load corresponds to a capacitance of a gate of a second device.

3. The transmitter of claim 2, whereby said first device has a first width, said second device has a second width.

4. The transmitter of claim 3, whereby said second width is more than five times greater than said first width.

5. The transmitter of claim 1, further comprising:

a parasitic capacitance associated with said first inductor, said drain and a second inductor associated with said via stack.

6. The transmitter of claim 5, whereby said parasitic capacitance and said inductors form a resonant circuit.

7. The transmitter of claim 1, whereby said different metal layer is a lower metal layer.

8. The transmitter of claim 1, whereby said performance is selected from said group consisting of gain, power delivery and resonant tuning.

9. A method of improving performance in a transmitter comprising the steps of:

forming a first inductor in an upper metal layer of a die;

coupling a drain of a device to said first, inductor using a via stack;

selecting a tap point of said via stack to maximize inductance placed in series with said first inductor and minimize resistance placed in series between a load and said drain;

tapping into said tap point with a different metal layer; and coupling said different metal layer to said load; thereby improving performance in said transmitter.

10. The method of claim 9, further comprising the steps of associating a parasitic capacitance with said first inductor, said drain and a second inductor associated with said via stack.

11. The method of claim 10, whereby said parasitic capacitance and said inductors form a resonant circuit.

12. The method of claim 9, whereby said load corresponds to a capacitance of a gate of a second device.

13. The method of claim 12, whereby said device has a first width, said second device has a second width.

14. The method of claim 13, whereby said second width is more than five times greater than said first width.

15. The method of claim 9, whereby said different metal layer is a lower metal layer.

16. The method of claim 9, whereby said performance is selected from said group consisting of gain, power delivery and resonant tuning.

17. A method of tuning a resonant circuit in a transmitter comprising the steps of:

forming a first inductor in an upper metal layer of a die;

coupling a drain of a device to said first inductor using a via stack;

selecting a tap point of said via stack to vary inductance placed in series with said first inductor to tune said resonant circuit;

forming said resonant circuit with said first inductor and a second inductor associated with said via stack which is placed in series with said first inductor and said tap point;

tapping into said tap point with a different metal layer; and coupling said different metal layer to a load; thereby tuning said resonant circuit in said transmitter.

18. The method of claim 17, whereby said load corresponds to a capacitance of a gate of a second device.

19. The method of claim 17, further comprising the steps of:

associating a parasitic capacitance with said first inductor, said drain and said second inductor associated with said via stack.

20. The method of claim 19, whereby said parasitic capacitance and said inductors form said resonant circuit.

21. An output stage comprising:

a first and a second device cross coupled to each other;

said first and second device having a first width are loaded with a portion of a resonant circuit;

a third device having a second width in parallel with said first device; and a fourth device having said second width in parallel with said second device; whereby said second width is at least five times said width of said first width.

22. The output stage of claim 21, further comprising;

a ground (VSS) coupled to all sources of said devices; and a power supply (VDD) coupled to said resonant circuit.

23. The output stage of claim 22, further comprising;

a first inductor coupled between a drain of said first device and said power supply; and a second inductor coupled between a drain of said second device and said power supply; whereby said resonant circuit is formed by said first and second inductors.

24. The output stage of claim 23, further comprising;

a third inductor magnetically coupled to said first and said second inductors.

25. The output stage of claim 24, further comprising;

an antenna coupled to said third inductor.

26. The output stage of claim 21, further comprising;

a first signal coupled to a gate of said third device; and a second signal coupled to a gate of said fourth device; whereby said first and second signals are formed by combining a differential and a common mode signal.

27. The output stage of claim 26, whereby a common mode noise is decreased in said output stage.

* * * * *